US009045867B2

(12) United States Patent
Lopez

(10) Patent No.: US 9,045,867 B2
(45) Date of Patent: Jun. 2, 2015

(54) METHOD AND DEVICE FOR HEATING WORN ROAD COATING MATERIALS

(75) Inventor: Emile Lopez, Salies de Bearn (FR)

(73) Assignee: FENIXFALT, Salies de Bearn (FR)

( * ) Notice: Subject to any disclaimer, the term of this patent is extended or adjusted under 35 U.S.C. 154(b) by 1732 days.

(21) Appl. No.: 10/588,763

(22) PCT Filed: Feb. 7, 2005

(86) PCT No.: PCT/FR2005/050075

§ 371 (c)(1),
(2), (4) Date: Oct. 4, 2006

(87) PCT Pub. No.: WO2005/075742

PCT Pub. Date: Aug. 18, 2005

(65) Prior Publication Data

US 2007/0172313 A1 Jul. 26, 2007

(30) Foreign Application Priority Data

Feb. 9, 2004 (FR) ..... 04 50225

(51) Int. Cl.
*E01C 7/06* (2006.01)
*E01C 19/10* (2006.01)

(52) U.S. Cl.
CPC ..... *E01C 19/1036* (2013.01); *E01C 19/1004* (2013.01); *E01C 2019/109* (2013.01)

(58) Field of Classification Search
USPC ..... 34/203, 217, 266; 366/7, 22, 23
See application file for complete search history.

(56) References Cited

U.S. PATENT DOCUMENTS

| | | | | | |
|---|---|---|---|---|---|
| 605,475 | A | * | 6/1898 | Edison | 34/207 |
| 2,093,998 | A | * | 9/1937 | Colbert | 427/218 |
| 2,355,670 | A | * | 8/1944 | Naeher et al. | 34/164 |
| 2,419,875 | A | * | 4/1947 | Birdseye | 34/431 |
| 2,419,876 | A | * | 4/1947 | Birdseye | 34/586 |
| 2,428,090 | A | * | 9/1947 | Naeher et al. | 241/10 |
| 2,452,983 | A | * | 11/1948 | Birdseye | 426/464 |
| 2,598,000 | A | * | 5/1952 | Knopp et al. | 34/385 |
| 2,722,749 | A | * | 11/1955 | Dargert | 34/543 |
| 3,398,900 | A | * | 8/1968 | Sweeney et al. | 241/67 |
| 3,776,529 | A | * | 12/1973 | Sutter et al. | 366/78 |
| 3,793,745 | A | * | 2/1974 | Myers | 34/189 |
| 4,011,023 | A | | 3/1977 | Cutler et al. | |
| 4,136,964 | A | * | 1/1979 | Swisher, Jr. | 366/23 |
| 4,347,016 | A | * | 8/1982 | Sindelar et al. | 404/95 |

(Continued)

FOREIGN PATENT DOCUMENTS

| | | | | |
|---|---|---|---|---|
| DE | 29 16 187 | | 10/1980 | |
| DE | 3723103 | A1 * | 1/1989 | E01C 19/10 |

(Continued)

*Primary Examiner* — David Sorkin
(74) *Attorney, Agent, or Firm* — Young & Thompson

(57) ABSTRACT

Process and device for heating a material constituted at least in part by worn road coatings to be recycled, particularly from milled materials or crushed agglomerates, characterized in that:

Figure 1:
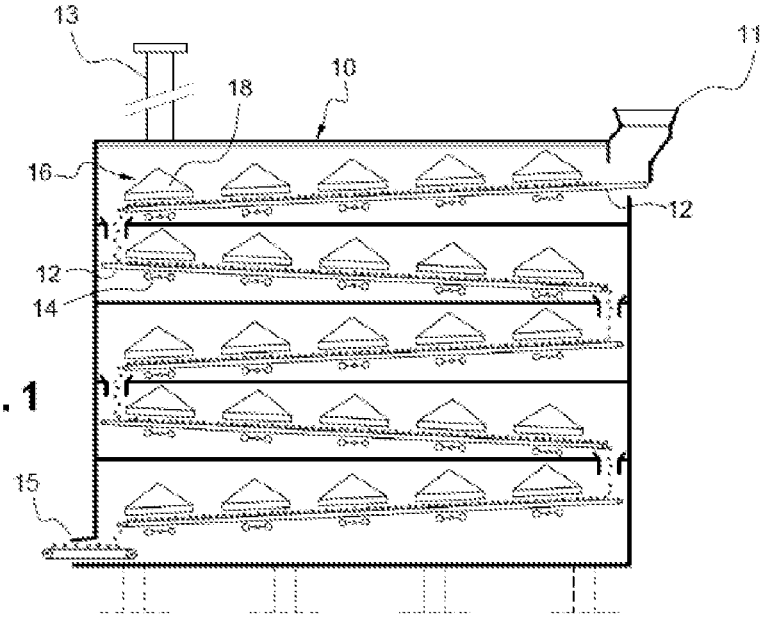

heating worn road coatings to a first temperature with the help of first radiant heating elements disposed adjacent the worn road coatings to be recycled, mechanically moving these worn road coatings to be recycled during this heating step, and heating the worn road coatings to a second temperature with the help of second radiant heating elements, disposed adjacent the worn road coatings to be recycled, so as to bring the coatings to a working temperature, between 160 to 220° C.

7 Claims, 2 Drawing Sheets

(56) References Cited

U.S. PATENT DOCUMENTS

| | | | | | |
|---|---|---|---|---|---|
| 4,540,287 | A | * | 9/1985 | Servas et al. | 366/7 |
| 4,787,938 | A | * | 11/1988 | Hawkins | 106/281.1 |
| 4,812,291 | A | * | 3/1989 | Friemel et al. | 422/28 |
| 4,910,540 | A | * | 3/1990 | Murray | 366/7 |
| 4,946,307 | A | * | 8/1990 | Jakob | 404/92 |
| 4,954,995 | A | * | 9/1990 | Marconnet | 366/7 |
| 4,957,710 | A | * | 9/1990 | Nagai et al. | 422/171 |
| 5,201,839 | A | * | 4/1993 | Swisher, Jr. | 366/4 |
| 5,273,355 | A | * | 12/1993 | May et al. | 366/23 |
| 5,277,490 | A | * | 1/1994 | Boon | 366/4 |
| 5,403,085 | A | * | 4/1995 | Banks | 366/23 |
| 5,478,530 | A | * | 12/1995 | Swanson | 422/170 |
| 5,557,858 | A | * | 9/1996 | Macaluso et al. | 34/273 |
| 5,580,535 | A | * | 12/1996 | Hoke et al. | 423/245.3 |
| 5,664,881 | A | * | 9/1997 | Hawkins et al. | 366/4 |
| 5,772,317 | A | * | 6/1998 | Butler | 366/7 |
| 6,162,477 | A | * | 12/2000 | Crisinel et al. | 426/256 |
| 6,164,809 | A | * | 12/2000 | Hawkins | 366/7 |
| 6,233,841 | B1 | * | 5/2001 | Beach | 34/262 |
| 7,681,326 | B2 | * | 3/2010 | Sugawara et al. | 34/93 |
| 2002/0131321 | A1 | * | 9/2002 | Hawkins | 366/7 |
| 2007/0070801 | A1 | * | 3/2007 | Musil et al. | 366/7 |
| 2008/0220133 | A1 | * | 9/2008 | Carman et al. | 426/320 |
| 2011/0110177 | A1 | * | 5/2011 | Velsor | 366/22 |

FOREIGN PATENT DOCUMENTS

| | | | | | |
|---|---|---|---|---|---|
| EP | 0 033 911 | | | 8/1981 | |
| EP | 0 146 939 | | | 7/1985 | |
| EP | 0 192 300 | | | 8/1986 | |
| GB | 2115711 | A | * | 9/1983 | B01F 13/10 |
| JP | 02286063 | A | * | 11/1990 | A23L 3/18 |
| JP | 03148587 | A | * | 6/1991 | F26B 17/08 |
| WO | WO 97/16600 | | | 5/1997 | |

* cited by examiner

METHOD AND DEVICE FOR HEATING WORN ROAD COATING MATERIALS

The present invention relates to a process and device for heating road coatings, particularly road coatings to be recycled.

There is known from European Patent No. 98 925705 in the name of the same applicant, a process for continuous production of modified bitumens requiring for example heating coatings.

The production of road coatings has several successive steps, which require heating and/or holding at temperature, steps which give rise to constraints to which should be brought solutions.

Moreover, constraints are known which are imposed by new legislation as to the environment, which explains the research into new processes for the performance of certain steps, particularly those of heating. Two situations are to be separately studied, the process of the device according to the invention finding application in either case, without modification.

At present, schematically stated, the production of road coatings comprises a first step of treating granulates.

These granulates are of different granulometries and mixed in suitable proportions for obtaining a base of granulates as a function of the covering to be produced.

These granulates must be mixed with bitumen, itself moreover prepared. So that the adhesion of the bitumen to the granulates takes place optimally, it is necessary that the bitumen, before mixing, be heated but also that the granulates be heated.

Moreover, the granulates must for example be free from water and the installations involving heating require for this cladding the drying of the granulates in a preliminary step.

One of the means to heat the granulates consists in using an oven of the rotating drum type, inclined, with a burner which emits a flame, this preferably countercurrent to the flow of granulates, the movement of the granulates being obtained by suitable inclination of the drum. A suitable rotation and fins and other agitation means disposed on the internal walls of said drum permit obtaining a good speed of movement and a desired agitation.

The burner is supplied by liquid or gaseous petroleum fuel and the flame generated is of suitable shape for propagation along the longitudinal axis of the drum.

The granulates are thus subjected to heating by different transmission paths: convection, conduction and radiation.

The essence of heat transfer arises from convection generated by the flow of hot gas from the flame. An air current is also associated with the combustion gas to cause to move in a suitable manner this hot gaseous flow.

Other heat transfer modes are minor, conduction being limited to contacts with the wall and the metallic agitating elements. As to radiation, this transfer is significant only adjacent the walls and/or the flame.

The different parameters: flow rate of granulate, direction of passage of the granulates relative to that of the flame, agitating energy and speed of circulation, length of the drum, power of the burner, air flow rate, nature of the combustibles and heating power, are chosen to achieve the desired result.

It will be seen that during this heating step, there is produced an emission of combustion gas which is evacuated to the atmosphere like water of evaporation.

On the other hand, during agitation of the granulates, it is necessary to observe two opposite requirements, because as soon as the granulates are agitated, they generate dust and as the gaseous flow rate is necessarily high, it is necessary to be able to treat the gas to recover all the fine particulates, this quantity being as much as of the order of 200 g/m$^3$ of evacuated gas.

The entering granulates can also be heated, dried and account taken of the environmental constraints for what is rejected.

These hot granulates are then if desired screen and stored and then measured and agitated in kneaders in the presence of fresh hot bitumen reserved moreover so as to clad them and to obtain a coating ready to be used. In certain cases, the coating operation takes place in the final portion of the heating drum, before the outlet.

To these coatings are added fines in an amount in addition to the fines recovered after filtering the heating gas at the time of coating so as to obtain the most compact coating layers.

The coating thus prepared is then deposited on a surface prepared to receive it and it is compacted in a vigorous manner before its cooling. During this cooling step, the bitumen plays its role of cohesion and binding agent.

The original formulation of the coating, nature and composition of the mixture of granulates, quantity and character of the bitumen, compactness of the layers, intensity of the traffic and the climate of the place of employment of the coating, then the modifications of granulometry produced by the operations of grinding for its recovery, have important influences on the recycling of the coatings.

Thus, hot recycling of the coatings consists in using for a part of even all the milled materials of the road. These recovered coatings are constituted by isolated granulates but also agglomerates whose elements are strongly bound by the bitumen. The analysis of the coating to be recycled indicates the granulometry of the mixture, the nature and the content of the bitumen present. A knowledge of these parameters will permit operations of supplemental bitumen supply and/or specific additives as well as supplemental fresh granulates and/or correctives.

On the other hand, the problem is the treatment of the recycled coatings, because it is a matter of heating granulates which are already clad with bitumen and which are present in the form of large or small particles isolated or in the form of agglomerates with the bitumen contained within these agglomerates. Known installations which recycle these coatings are identical to those for new granulates. The rotating furnace provided with a burner is used but the arrangements avoid placing in contact the coatings directly with the flame.

However, it is known that the flame, which is of the order of 1000° C. at the outlet of the burner, propagates while remaining at 900° C. at its end. The gases then pass to 700° C. outside of the zone of the flame to fall to about 200° C., which is to say 50° above the temperature to be reached within the coating.

There are thus different undesirable phenomena which arise in the bitumen.

First of all, given the maximum temperatures reached in certain regions of the furnace, well beyond the temperatures of production of the bitumen at the refinery, there are obtained phenomena of degradation particularly by cracking and pyrolysis. These phenomena give rise to aging of the recycled bitumen. The combustion gases bring with them volatile organic compounds, in a quantity very much greater than the permitted standards.

Moreover, in parallel to the phenomenon of aging, the gas flow from the combustion, to which are added very large quantities of air for its diffusion in the chamber, gives rise to oxidation and supplemental evaporation adding to the degradation.

As in the case of new granulates, the fines present are entrained with the gaseous effluent. The small size and limited mass lead to a very rapid increase in temperature relative to the other granulates and hence rapid and easy detachment from the support.

In contrast to new granulates, these entrained fines are impregnated with bitumen and hence strongly adhesive.

During mechanical withdrawal by filtration, no matter what the method used, there is produced a clogging of the circulation conduits.

As to the filters, they rapidly clog and finally prevent their good operation.

The recycling should take place not only from units of production established at a fixed position, but also for disassembleable and moveable installations as in the case of units operating directly on the roadway to be treated. For these latter, operating by continuous withdrawal of the milled products also produced continuously, the problems mentioned above are intensified, particularly as to what is rejected. The same is true of devices heating the surface of the roadway to be recycled, the heat transfer being impossible throughout the thickness of the layer of coating because of poor heat transfer and with consequent degradation of the bitumen.

The present invention proposes solutions to overcome the problems set forth above and uses heating means with radiant panels with a particular arrangement permitting illustrating the process and providing a solution in the form of a device, which is satisfying but not limiting.

Figure 2:
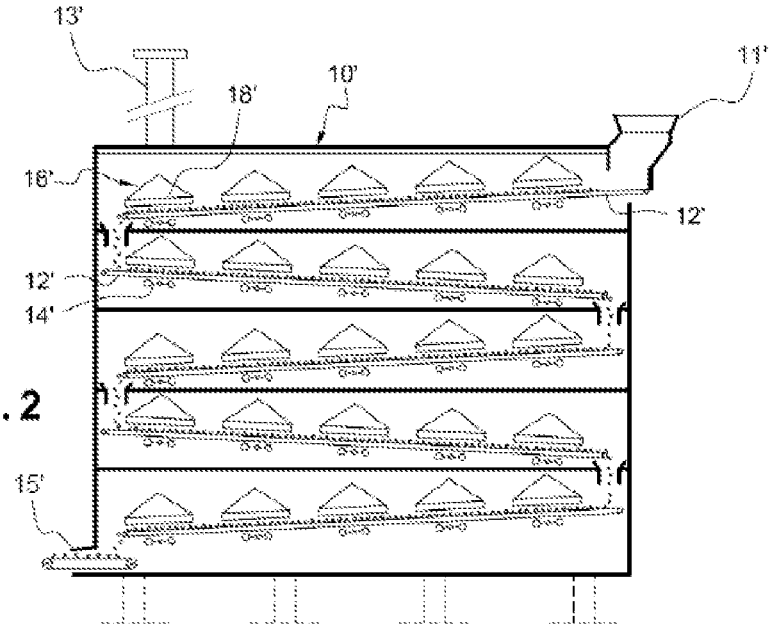
Figure 3:
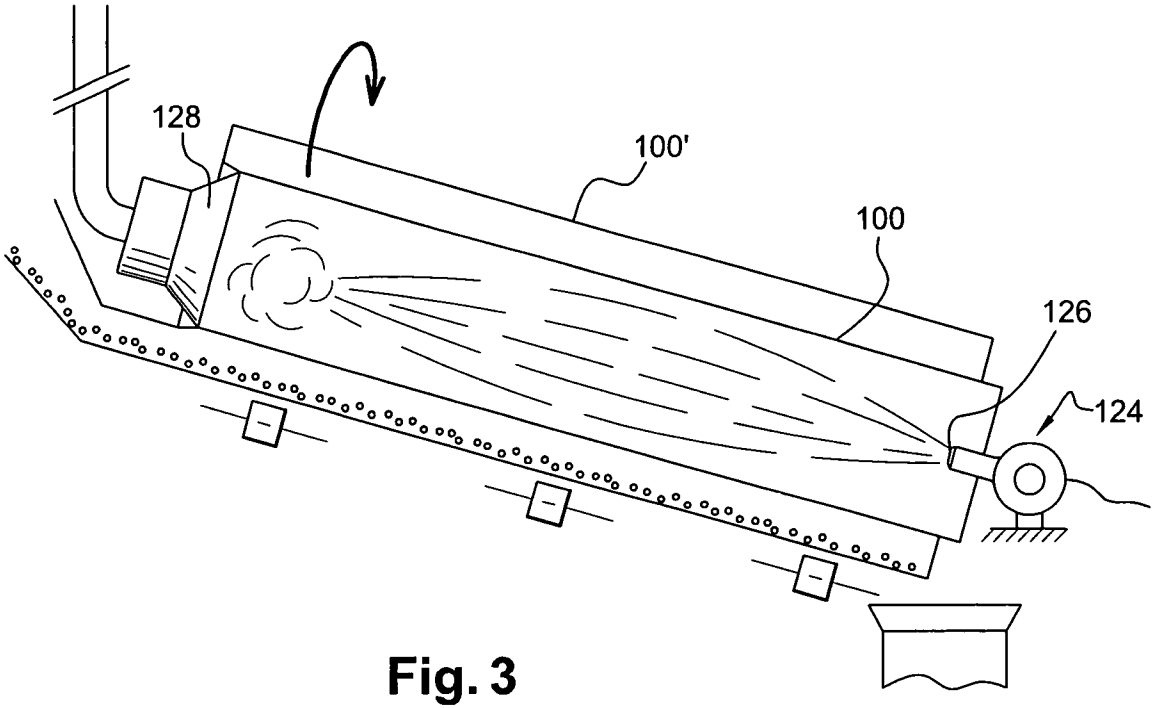

So as better to explain this device, the process and the device will now be described in detail, according to one embodiment, with the accompanying drawings, on which the different figures represent:

FIG. 1: a schematic side elevational view of a first treatment module according to the present invention permitting the practice of the process FIG. 2: a schematic side elevational view of a second treatment module according to the present invention, and FIG. 3, a view of a modified embodiment of a chamber of the treatment module.

The process according to the present invention consists in treating clad milled products in a device provided with means for radiant heating with panels.

There is meant in the following description, by milled products, the coatings issuing from milling but also the coatings arising from mechanical withdrawal of blocks and crushed materials.

Similarly, the terms "radiant heating with panels" used, cover all surface arrangements adapted to emit radiation leading to radiant heating.

This permits treating the fluid products without giving rise to violent air currents imposed by the heating methods of the prior art, by combustion.

Moreover, it is impossible to reach different temperatures within a same module because it suffices to adjust the emission of heat as a function of the load.

It will be noted that, thanks to this mode of heating, even in the case of low heating power, the latter remains perfectly distributed, thanks to the panels which emit heat in a homogeneous manner. In the case of a flame, when the power is decreased, the distribution is also modified in an important way.

The maximum temperature at any point reached, cannot exceed the temperature of deterioration of the bitumen as will be indicated hereafter.

These characteristics lead to immediate advantages which solve the first great problems which have been mentioned above.

Nevertheless, it is necessary then to obtain the final result sought, namely, the heating of the granulates already clad with bitumen.

However, to give an indication of magnitude, it is known that the assembly of the mixture of granulates has a specific surface of 15 to 20 $m^2$ per kilogram, with about 50 grams of bitumen, which leads to thicknesses of bitumen pellets of several microns.

The majority of these pellets are trapped in agglomerates constituting the milled products and this structure should be maintained during heating to reduce the creation of new surfaces exposing the bitumen to the air.

Between the large elements comprising the agglomerates are located fractions of fine and very fine mineral elements. These fractions have a mass equal to a greater quantity of bitumen because of the differences of specific surface.

These agglomerates must remain cohesive in a preferential manner. There is thus required a process for mechanical treatment that is sufficiently flexible.

The process also consists in mechanically conveying preferentially by gravity but also by forced conveying and with vibrations. These vibrations, during their emission, will have at least one vertical component, preferably with high amplitude, so as to permit regularly a return of the grains. This modification of orientation permits a homogeneity of presentation of the assembly of the surface of each grain to the infrared radiations of the radiant heating means.

It will be seen in this instance that the bitumen is not exposed in a large way to the air and hence to the oxygen which it contains, which would give rise to oxidation and accelerated aging.

The associated device is shown in FIG. 1. It comprises a first chamber 10 in which are disposed conveyors or transfer screens 12. This chamber is of substantially parallelepipedal shape in this embodiment so as to be as simple as possible.

In the case of movable machines, the device is necessarily of the roadway type to permit movement and positioning immediately adjacent the workplace. This same limitation to roadway manner is applicable to movable machines which move continuously along the work way to work on the milled material continuously. The limitation of the size of the device and the requirement for sufficient dwell time of the coatings gives rise to constraints.

Also, there are provided several transfer belts disposed one below the other, these belts being inclined or horizontal and vibrated by a suitable means 14 for vibrating them and for example with eccentric motors. Above these belts, there are provided means 16 of the radiant heating type, in the form of panels 18. The power, distribution and energy supply means will be suitable to the treatment capacity. Thus, it is necessary to take account of the fact that the materials to be treated contain a certain quantity of water which must be eliminated, and the dwell time, and the heating power are parameters to be taken into account also during dimensioning of the installation.

In the process in question, the temperature of the coating to be achieved at the outlet 15 is of the order of 105 to 130° C. so as to place the bitumen in a viscous condition and to cause complete evaporation of the water and total drying of the introduced materials at the inlet 11.

The gases generating during heating, the water vapor as well as the most volatile organic products, issuing from the bitumen, are evacuated to the atmosphere by means for evacuating the gaseous effluents 13, but it will be seen that the gaseous effluents contain very reduced proportions of organic substances at these temperatures.

The process then provides a second step which consists in bringing the coating to the final working temperature, namely 160 to 220° C., in a second module. Prior to this, the grains and agglomerates from the first module are preferably introduced continuously into means to agglutinate the fine elements, the grains and agglomerates. The fines ensure cohesion.

It is a hot and completely dry material, at about 105 to 130° C., constituting by a agglomerates of cohered elements, which is then brought according to the process of the invention to a temperature of 160 to 220° C.

Indeed, there are produced emissions of organic products because the temperatures are higher and these emissions must be treated before discharging them to the atmosphere. It will nevertheless be noted that the air currents being avoided and the elements having been agglutinated, the entrainment of fines is extremely reduced, or even avoided.

In the second module substantially identical to the first, there is modified the heating power to provide the heat difference and to achieve the desired temperature.

Another problem that may arise is the treatment of the gaseous effluents. This can be treated effectively by passage through decomposition catalysts which for many reasons are sensitive to moisture. Indeed, the elimination of water in the first module is highly important also to solve this problem.

The second module shown in FIG. 2 is substantially identical in its design to the first module and the identical elements bear the same reference numerals with a "'".

On the other hand, in a manner not shown but with reference to known devices, there should be provided scraper means to eliminate the bituminous deposits on the conveyors or belts.

The coatings from this second module can be comprised by 100% of materials to be recycled. There should be added additives for regeneration of the old bitumen, this operation being carried out in a kneader, continuously. These additives are first warmed and measured according to a quantity for a ratio with the mass flow rate of the recycled coatings in a continuous production unit or a mass of coating first weighed with introduction into the kneader for a discontinuous unit.

Once more the importance of the elimination of water in the first module should be stressed.

The coating from the second module can be recycled with a ratio of virgin granulates which are introduced conjointly with the worn coating into the first module. This virgin material is moreover prepared continuously.

In addition to the bitumen supplied by the worn coating, there are added regeneration additives and new bitumen as well as the fine materials.

At the outlet of the kneader, the coating including all or a portion of the recycled coating is ready to be used.

According to a modification of the device of the invention, it is possible to use the radiant surface in a different way. In this case, see with reference to FIG. 3, there are provided two coaxial rotatable and inclined cylinders 100, 100'.

The central cylinder 100 receives the heating means 124, for example burner 126 using liquid fuel. The combustion gases are evacuated continuously at the upper end 128 of the central cylinder, the burner being disposed in the lower portion.

The coatings are introduced into the space between the two cylinders, in the upper portion and circulate by gravity downwardly.

The rotation ensures the presentation of all the surfaces of the grains to the infrared radiation emitted by the external wall of the central cylinder.

It will moreover be noted that the grains and the bitumen which bind them, are never in contact with the combustion gases, which eliminates any problems of airborne coated fines.

At the outlay, the effluents are treated as before, before returning to the atmosphere.

In this modification, the radiant surfaces are curved and can be provided with any suitable agitation means.

The process and devices according to the present invention permit solving the problems arising from recycling old coatings while respecting the environmental constraints.

The invention claimed is:

1. A device for heating a material constituted at least in part by worn road coatings to be recycled, comprising:

a first enclosed chamber having an upper portion and a lower portion, an inlet in the upper portion for receiving the worn road coatings to be recycled, an outlet in the lower portion for discharging the worn road coatings from the first enclosed chamber, a means for transferring the worn road coatings to be recycled from the inlet to the outlet, the means for transferring comprising inclined conveyors or inclined transfer screens, a means for radiant heating the worn road coatings to be recycled, the means for radiant heating providing sufficient heat to reach a first temperature between 105 and 130° C. and to render bitumen therein viscous, and a means for evacuating gaseous effluents from the first enclosed chamber; and a second enclosed chamber having an upper portion and a lower portion, an inlet in the upper portion for receiving the worn road coatings discharged from the first enclosed chamber, an outlet in the lower portion for discharging the worn road coatings from the second enclosed chamber, a means for transferring the worn road coatings to be recycled from the inlet to the outlet, the means for transferring comprising inclined conveyors or inclined transfer screens, a means for radiant heating the worn road coatings from said first enclosed chamber introduced to the inlet of the second enclosed chamber, the means for radiant heating providing sufficient heat to reach a second temperature between 160 and 220° C., and a means for evacuating gaseous effluents from the second chamber; and a horizontal conveyor for receiving the heated worn road coatings, disposed at the outlet of the first enclosed chamber.

2. The device according to claim 1, wherein each of the first and second enclosed chambers is a substantially parallelepipedal enclosed chamber and wherein the means for transferring in each of the first and second enclosed chambers further comprise a means for vibrating the inclined conveyors or inclined transfer screens, and wherein said means for radiant heating comprises panels.

3. The device according to claim 1, further comprising decomposition catalysts for treating the gaseous effluents emitted from the second enclosed chamber.

4. The device according to claim 2, wherein the means for transferring further comprises horizontal conveyors.

5. A device for heating a material constituted at least in part by worn road coatings to be recycled, comprising:

a first enclosed chamber for heating worn road coatings to a first temperatures between 105 and 130° C. and to render bitumen therein viscous, the first enclosed chamber having an inlet at an upper portion and an outlet at a lower portion, a plurality of inclined conveyors disposed between the inlet and the outlet such that worn road coatings are transferred from one conveyor to another in a continuous manner from the inlet to the outlet, radiant heat panels being positioned proximate to the plurality of inclined conveyors for achieving the first temperature, and an opening in the upper portion for evacuating gaseous effluents;

a horizontal conveyor disposed at the outlet of the first enclosed chamber for receiving the heated worn road coatings;

a second enclosed chamber for heating the heated worn road coatings from the first enclosed chamber to a second temperatures between 160 and 220° C., the second enclosed chamber having an inlet for receiving the heated worn road coatings from the first enclosed chamber at an upper portion and an outlet at a lower portion, a plurality of inclined conveyors disposed between the inlet and the outlet such that worn road coatings are transferred from one conveyor to another in a continuous manner from the inlet to the outlet, radiant heat panels being positioned proximate to the plurality of inclined conveyors for achieving the second temperature, and an opening in the upper portion for evacuating gaseous effluents from the second enclosed chamber.

6. The device according to claim 5, wherein the plurality of inclined conveyors of the first enclosed chamber include a means for vibrating the inclined conveyors.

7. A device for heating a material constituted at least in part by worn road coatings to be recycled, comprising:

a first enclosed chamber having an upper portion and a lower portion, an inlet in the upper portion for receiving the worn road coatings to be recycled, an outlet in the lower portion for discharging the worn road coatings from the first enclosed chamber, a means for transferring the worn road coatings to be recycled from the inlet to the outlet, the means for transferring comprising inclined conveyors or inclined transfer screens, a means for vibrating the inclined conveyors or inclined transfer screens, a means for radiant heating the worn road coatings to be recycled, the means for radiant heating providing sufficient heat to reach a first temperature between 105 and 130° C. and to render bitumen therein viscous, and a means for evacuating gaseous effluents from the first enclosed chamber;

a horizontal conveyor for receiving heated worn road coatings disposed at the outlet of the first enclosed chamber; and a second enclosed chamber having an upper portion and a lower portion, an inlet in the upper portion for receiving the worn road coatings discharged from the first enclosed chamber, an outlet in the lower portion for discharging the worn road coatings from the second enclosed chamber, a means for transferring the worn road coatings to be recycled from the inlet to the outlet, the means for transferring comprising inclined conveyors or inclined transfer screens, a means for vibrating the inclined conveyors or inclined transfer screens, a means for radiant heating the worn road coatings from said first enclosed chamber introduced to the inlet of the second enclosed chamber, the means for radiant heating providing sufficient heat to reach a second temperature between 160 and 220° C., and a means for evacuating gaseous effluents from the second chamber.

* * * * *